United States Patent [19]

Metz

[11] 4,314,790

[45] Feb. 9, 1982

[54] METHOD OF AND DEVICE FOR SHIPPING HOT METAL GOODS

[75] Inventor: Paul Metz, Luxembourg, Luxembourg

[73] Assignee: Arbed S.A., Luxembourg, Luxembourg

[21] Appl. No.: 68,665

[22] Filed: Aug. 22, 1979

[30] Foreign Application Priority Data

Aug. 22, 1978 [LU] Luxembourg ..... 80145

[51] Int. Cl.[3] ..... B60P 3/00

[52] U.S. Cl. ..... 414/786; 414/373; 164/34; 164/412; 266/274

[58] Field of Search ..... 414/786, 473, 373; 266/44, 142, 143, 165, 274, 252; 432/276, 287, 24, 27, 15, 58; 164/34, 35, 412

[56] References Cited

U.S. PATENT DOCUMENTS

| | | | |
|---|---|---|---|
| 2,985,929 | 5/1961 | Carter | 164/34 |
| 3,526,266 | 9/1970 | Snelling | 164/34 |
| 3,605,869 | 9/1971 | Chapman et al. | 164/34 X |
| 4,085,790 | 4/1978 | Wittmoser | 164/34 |

*Primary Examiner*—Trygve M. Blix
*Assistant Examiner*—L. E. Williams
*Attorney, Agent, or Firm*—Karl F. Ross

[57] ABSTRACT

A method of and a device for the shipping of hot metal goods, such as hot steel ingots and slabs, in which the ingots or slabs are lowered into a container in which a granular insulating material, preferably porous vermiculite, is fluidized by a pressurized gas during the introduction of these metal goods. The particles of the insulating material, upon termination of the fluidization are then allowed to pack around and envelop the metal goods. The insulating material is again fluidized during withdrawal of the metal goods at the unloading site.

15 Claims, 1 Drawing Figure

METHOD OF AND DEVICE FOR SHIPPING HOT METAL GOODS

FIELD OF THE INVENTION

This invention relates to a method of and a device for shipping hot metal goods, particularly hot ingots, slabs and the like with reduced thermal losses.

BACKGROUND OF THE INVENTION

The problem of shipping hot metal goods with low losses of heat will rise whenever cast or pre-rolled metal goods have to be shipped to more or less remote facilitates.

The distances to be covered can range from a few hundred meters to several kilometers. The greater distances increase the problem of loss of thermal energy problem even more serios than losses of thermic energy as i.e. the progressive increase in the difference in temperature between product surface and product core.

To heat the goods to their initial temperature and make up for the loss due to shipping, requires considerable energy and substantial time, especially when massive metal bodies like steel ingots or slabs are to be shipped.

Therefore carriages used for shipping such goods have to be carefully insulated at their bottom, at their walls and at their roof. The expensive heat-resisting insulators that are used for this purpose are stressed thermally as well as mechanically, especially when the carriage is being loaded or unloaded. These carriages are equipped with replaceable insulating panels.

The cost of shipping hot metals goods over short or long distances are high owing to the price of the insulating materials and to the labor involved.

OBJECT OF THE INVENTION

The object of the invention therefore is to provide a method of and a device for shipping hot metal goods with reduced thermal losses, avoiding the abovementioned difficulties.

SUMMARY OF THE INVENTION

This object is attained by shipping the hot metal goods in a container on wheels and which comprises wrapping the hot metal goods in a shroud of granular or powdered insulating material, while fluidizing the insulative material with a gas stream upon introducing the goods into the container, so that the goods may be set upon the bottom of said container and interrupting the gas flow once the container is loaded, thereby allowing the insulating material to tightly settle around the goods.

A quantity of insulating material is used sufficient to assure that once the fluidizing gas flow is interrupted, the goods are completely covered with insulating material.

It is also advantageous to fluidize the insulating material during the unloading of the shipped goods.

The advantage obtained by the procedure is that the hot metal goods are tightly wrapped in a layer of mobile insulating material, on loading and during transportation. Fluidizing the insulating material on loading again yields two advantages, the first consisting in creating a dynamic medium inside the container into which the goods can be introduced without difficulty and enabling the goods to be set upon the bottom of the container. The second advantage is that any metal goods, of any geometry will always be totally enveloped in insulating material with a constant density and a constant heat transfer coefficient.

The degree of heat retention that can be reached through this procedure thoroughly simplifies insulation of the carriage walls and roof and increases their life.

In a preferred embodiment of the method I pneumatically remove at least a part of the insulating material during fluidizing upon loading or unloading. This step is especially advantageous during the unloading of the goods, because when at least part of the fluidized material is being removed the crane operator obtains a clear view of the situation.

The insulating material preferred is porous vermiculite. The criteria for choosing an adequate material are: A low density, a favorable mean grain size, usually 2–4 mm, and a low heat transfer coefficient plus a high abrasion resistance.

The gas used to fluidize the insulating material may be any gas or gas mixture which under the given circumstances does not react with the hot metal or with the insulating material. Thus air may well be used as a fluidizing agent when normal carbon steel is to be shipped.

Neither the price of the insulating material, of which only limited amounts are needed when good use is made of the space available in the container, nor the costs of the fluidizing operation, which apply only on loading and on unloading, is an inhibiting factor.

The device which is needed to carry out the method comprises a container sitting on wheels and having a movable roof, or cover the container being advantageously made of steel. Its bottom is protected by a layer of refractory material in which there are set several gas-permeable plates, and gas conduits are installed below the container bottom to serve as inlets for pressurised gas which are connected to the gas-permeable plates.

The gas-permeable plates may be of porous refractory sintered material, of sintered metal or as replaceable sheets or tubes of refractory steel, having minute holes.

Further the container bottom preferably has longitudinal ribs along both sides of the gas-permeable plates and raised in height to prevent the metal goods from touching the gas-permeable plates. They may be rails, bars or refractory bricks.

The gas conduits which are connected to the permeable plates can be form a carriage support, adding to its rigidity.

A preferred embodiment of the device comprises at least one pneumatic feeding pump fixed on the carriage and at least one bunker, the feeding device being connected to the container and to the bunker, in order to feed the granular or powdered insulating material to and from the bunker.

The movable roof of the container may be on rollers moving horizontally, or else can be comprised of several lids. Owing to the degree of heat retention that can be reached here, the roof is meant to prevent part of the insulating material from being blown out of the moving container and to keep the material dry, rather than prevent losses of heat.

BRIEF DESCRIPTION OF THE DRAWING

The sole FIGURE of the schematic drawing shows in section a preferred embodiment of the device.

SPECIFIC DESCRIPTION

Figure 1:
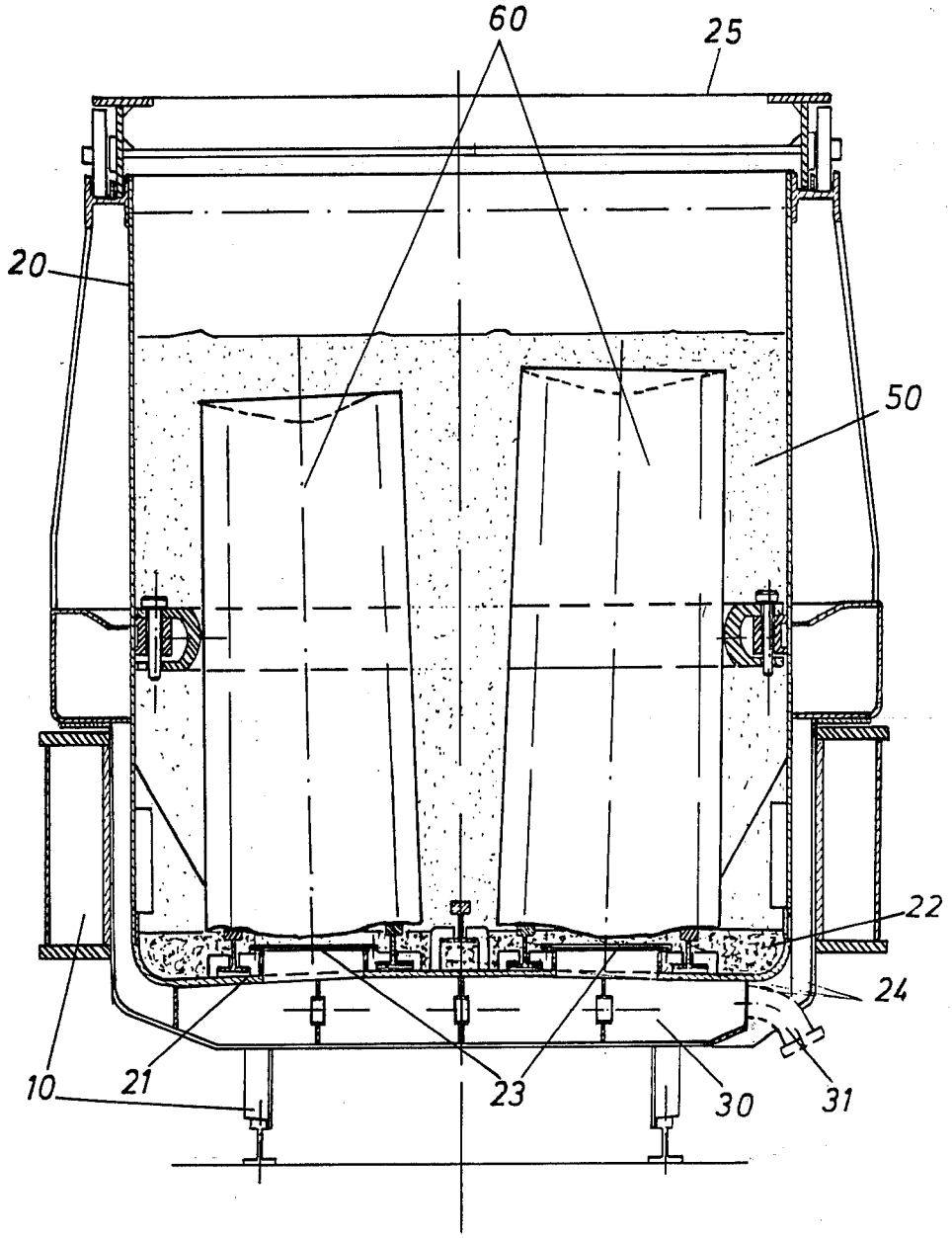

The drawing shows a cross section of the device in a loaded state and without fluidization in progress.

It shows the steel container 20 on a wheel support 10. Although the latter is embodied here as a railway carriage, the container can move on wheels other than railway wheels.

The bottom 21 of the container 20 has a refractory concrete layer 22 in which there are inserted the porous gaspermeable plates 23.

The internal rails 24 which rest upon the bottom 21, alongside the plates 23, act as supports for the ingots 60, preventing contact of the plates by the ingots. The ingots 60 may be secured against tumbling with the help of side pieces.

Below the bottom 21 there is a gas conduit 30 adding to the rigidity of the wheel-support 10 and comprising a gas inlet 31.

The container shown comprises a horizontally movable roof 25 on rollers.

The insulating material 50 totally surrounds the ingots 60. The container comprises no special insulation aside from the refractory concrete layer 22. As mentioned before, the walls and the roof may also comprise conventional insulating panels for transport over especially long distances.

What we claim is:

1. A method of shipping hot metal goods, comprising the steps of:

(a) introducing a granular insulating material into an open-top wheeled container;

(b) fluidizing said material in said container with a pressurized gas introduced into said container at the bottom thereof;

(c) lowering the hot metal goods into said container during the fluidization of said material to enable said metal goods to rest upon the bottom of said container;

(d) terminating the fluidization of said material in said container upon introduction of said metal goods into said container in step (c), thereby permitting said material to pack around and envelop the metal goods in said container;

(e) covering said container; and (f) displacing said container on its wheels.

2. The method defined in claim 1, further comprising the steps of:

(g) uncovering said container following step (f);

(h) fluidizing said material in said container enveloping said metal goods by introducing pressurized gas through the bottom of said container; and (i) lifting said metal goods from said container during the fluidization of said material in said container in step (h).

3. The method defined in claim 2 wherein at least a portion of said material is pneumatically entrained into said container during the fluidization of said material in step (b) and a portion of said material is removed from said container pneumatically during the fluidization of said material in step (h).

4. The method defined in claim 2 wherein said insulating material is porous vermiculite.

5. The method defined in claim 2 wherein said material has a mean grain size of 2 to 4 mm.

6. The method defined in claim 2 wherein said pressurized gas is a gas which does not react during fluidization of said material with hot metal goods and with said material.

7. A device for the shipping of hot metal goods comprising:

(a) an upwardly open container;

(b) wheels on the bottom of said container enabling displacement thereof from a loading site to an unloaded site;

(c) means including a plurality of gas-permeable plates for admitting a pressurized gas into said container at the bottom thereof to fluidize granular insulating material as hot metal goods are lowered into said container and are removed therefrom whereby upon termination of the introduction of said gas through said plates, said insulating material can pack around and envelop hot metal goods in said container;

(d) a cover for said container movable to permit the introduction of said hot metal goods to said container and removal of said hot metal goods from said container; and (e) a gas conduit communicating with said plates and disposed therebelow for feeding said pressurized gas to said plates.

8. The device defined in claim 7 wherein said plates are porous heat-resistant sintered ceramic bricks.

9. The device defined in claim 7 wherein said plates are porous heat-resistant sintered metal.

10. The device defined in claim 7 wherein said plates are composed of perforated sheet metal.

11. The device defined in claim 7 wherein said plates are formed by steel tubes.

12. The device defined in claim 7, further comprising means for removably mounting said plates in said container.

13. The device defined in claim 7, further comprising rails formed in said container and having upper surfaces disposed above said plates whereby metal goods resting on said surfaces are maintained out of engagement with said plates.

14. The device defined in claim 7 wherein said container is formed with a carriage provided with said wheels, said conduit being formed on said carriage and rigidifying same.

15. The device defined in claim 14 wherein said carriage is provided with a bunker for said insulating material and with means for feeding said insulating material pneumatically from said bunker into said container and from said container into said bunker.

* * * * *